United States Patent [19]

Heise et al.

[11] Patent Number: 4,544,372

[45] Date of Patent: Oct. 1, 1985

[54] PROCESS FOR IMPROVING THE LIGHT FASTNESS OF POLYAMIDE DYEINGS

[75] Inventors: Klaus-Peter Heise, Bergisch Gladbach; Robert Kuth; Karl Neufang, both of Cologne; Hellmuth Pantke, Leichlingen; Karlfried Wedemeyer, Cologne, all of Fed. Rep. of Germany

[73] Assignee: Bayer Aktiengesellschaft, Leverkusen, Fed. Rep. of Germany

[21] Appl. No.: 557,687

[22] Filed: Dec. 2, 1983

[30] Foreign Application Priority Data

Dec. 20, 1982 [DE] Fed. Rep. of Germany ..... 3247051

[51] Int. Cl.[4] ..... D06P 1/64

[52] U.S. Cl. ..... 8/602; 8/624

[58] Field of Search ..... 8/602, 624

[56] References Cited

U.S. PATENT DOCUMENTS

| | | | |
|---|---|---|---|
| 3,203,752 | 8/1965 | Mills et al. | 8/551 |
| 4,383,835 | 5/1983 | Preuss et al. | 8/624 |

FOREIGN PATENT DOCUMENTS

| | | |
|---|---|---|
| 0018775 | 11/1980 | European Pat. Off. . |
| 3041153 | 6/1982 | Fed. Rep. of Germany . |
| 799742 | 8/1958 | United Kingdom . |
| 1321645 | 6/1973 | United Kingdom . |

OTHER PUBLICATIONS

Stary, J., The Solvent Extraction of Metal Chelates, MacMillan Co., N.Y. 1964, pp. 108, 109, 34, 35.

Chemical Abstracts, vol. 97, No. 12, Sep. 1982, p. 84, #93875e, Toray Industries, Inc.

*Primary Examiner*—Paul Lieberman

*Assistant Examiner*—John F. McNally

*Attorney, Agent, or Firm*—Sprung Horn Kramer & Woods

[57] ABSTRACT

The light fastness of dyed polyamide fibre materials, in particular of the type used for manufacturing car seat covers, can be substantially improved by treating these materials, before, during or after the dyeing, with copper compounds of the compounds of the formula

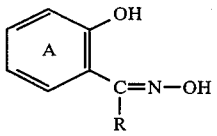

(I)

wherein R=H, OH, alkyl or cycloalkyl. The compounds (I) are distinguished by low self-colour and good stability to acid conditions.

8 Claims, No Drawings

PROCESS FOR IMPROVING THE LIGHT FASTNESS OF POLYAMIDE DYEINGS

For some years the automotive sector has been making increasingly tough demands on the light fastness of dyed textile materials which are based on preferably synthetic polyamide fibres and are used to prepare seat covers. This high fastness level, however, is not attained by most commercially available polyamide dyestuffs. This is particularly true even of the metal complex dyestuffs which, because of their outstanding light fastness, are used for said purpose to the virtual exclusion of other dyestuffs. Proposals have therefore already been made to meet the high requirements of car manufacturers by using the metal complex dyestuffs together with UV absorbers.

German Patent Specification A No. 3,041,153, for example, recommends that the polyamide textile materials should be treated, before, during or after the dyeing, with copper complexes of Schiff's bases.

However, this method, which is well proven in itself, has the disadvantage that the light fastness improvers it makes use of have an undesirable self-colour and a not fully adequate stability to acid conditions.

The reason why this acid stability is so critical is that, in practice, the dyeing frequently needs to be followed by finish-application treatments within the acid range of pH 4–6 to finish the dyed material in full.

It has now been found that the light fastness of polyamide dyeings can be improved with, preferably metal complex dyestuffs without having to accept the abovementioned disadvantages of an aftertreatment in an acid medium if copper compounds of phenols of the formula

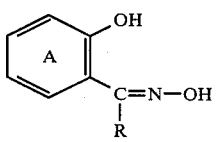

(I)

wherein

R=H, OH, alkyl or cycloalkyl and the ring A can optionally contain further substituents customary in the chemistry of UV absorbers, are used.

Suitable alkyl radicals are those having 1 to 4 C atoms. Suitable cycloalkyl radicals are cyclohexyl and methylcyclohexyl radicals. Suitable substituents in the ring A are methyl, methoxy or chlorine. However, this ring is preferably unsubstituted.

A further advantage of the copper compounds according to the invention is their lower self-colour, compared with, for example, the abovementioned copper complexes of Schiff's bases.

The copper compounds according to the invention are used in amounts of 0.01–2%, preferably 0.05 to 0.1%, on weight of polyamide. They are preferably added to the dyebath.

The copper compounds to be used in the manner of the invention are known (for example the salicylaldoxime-copper(II) complex from Ber. 63, 1928–30 (1930), the 2-hydroxyacetophenoxime-copper(II) complex from Ber. 64, 1210–1215 (1931)) or can be obtained in a manner which is known in itself, namely by reacting compounds of the formula I with a copper(II) salt, in particular with a salt of a mineral acid, such as copper(II) chloride or copper(II) sulphate, or copper(II) oxide (hydroxide), in a preferably alcoholic, aqueous alcoholic or aqueous medium. Preferably 1 to 2 mol of compound I are reacted per mol of copper compound. The reaction products are accordingly the corresponding 1:1 and 1:2 copper complexes or (in the case of the hydroxamic acid derivatives) presumably the corresponding acid and neutral copper salts.

It is also known in principle that transition metal complexes of compounds (I) are suitable for use as light fastness improvers, but they have so far always been used for other substrates, such as, for example, cellulose fibres (cf. British Patent Specification Nos. 1,321,645 and 1,392,953), modified polyolefine or polyacetal fibres (cf. U.S. Pat. No. 3,203,752) or ethylcellulose polymers (cf. German Patent Specification A No. 2,625,386). These patent specifications, moreover, did not describe the copper complexes—if mentioned at all—by way of examples or as particularly preferred, but almost exclusively the nickel complexes, which forces the conclusion that the copper complexes are less suitable.

For this reason it has to be regarded as very surprising that, in improving the light fastness of polyamide dyeings, it is solely the copper derivatives of (I) which give the desired effect, while the nickel complexes have a much smaller effect, if any.

"Polyamide" is, incidentally, to be preferably understood as meaning synthetic polyamide fibres.

These fibres can be conventionally dyed not only with metal complex dyestuffs but also with acid dyestuffs. The preferred dyestuffs are the metal complex dyestuffs, in particular the 1:2 chromium or 1:2 cobalt complexes of monoazo or diazo compounds, of which a large number have been described in the literature and are commercially available. These dyestuffs can also contain 1–2 sulpho groups.

Suitable acid dyestuffs are in particular those types which are usually used in combination with metal complex dyestuffs.

The polyamide materials can be treated with the copper compounds to be used according to the invention before, during or after—preferably during—the dyeing.

If they are not water-soluble, the copper compounds, which will normally have been prepared separately, are of course used in a finely divided form as is obtained by grinding in the presence of customary dispersants.

In a special embodiment of the process according to the invention, the process is carried out as a one-vessel process, as it were, in which the copper compounds for treating the fibre materials are not added in their solid, isolated form, but are produced, principally in any order, in situ on the fibre from the corresponding starting materials.

In this version of the process the fibres are preferably first dyed with a dyeing liquor which, in addition to the dyestuff and customary dyeing auxiliaries, contains the metal-free compounds of the formula I, and are then aftertreated with a copper(II) salt solution.

PREPARATION EXAMPLES

Example 1

A (2:1) salicylhydroxamic acid/copper compound 76.5 g (0.5 mol) of commercially available salicylhydroxamic acid are introduced into 500 ml of water and are dissolved by adding 40 g of a 50% strength sodium hydroxide solution (0.5 mol), and 62.5 g (0.25 mol) of $CuSO_4 \times 5H_2O$ are added dropwise with stirring in the form of a saturated aqueous solution. The mixture is stirred for 10 minutes, and the green precipitate is filtered off, is taken up in water, is reprecipitated by stirring and is filtered once more. Drying in vacuo (200 mbar) at 60° C. leaves 92.5 g (theoretical: 91.9 g) of a greenish grey powder. The copper content in the product was measured as 18.1%.

Example 2

A (1:1) salicylhydroxamic acid/copper compound 58 g (0.38 mol) of salicylhydroxamic acid are introduced into 380 ml of water, and 60.7 g of a 50% strength sodium hydroxide solution (0.76 mol) are added. 94.8 g (0.38 mol) of $CuSO_4 \times 5H_2O$ are added dropwise with stirring at 50° C. in the form of a saturated aqueous solution. The mixture is stirred for 10 minutes, and the green precipitate is filtered off, is taken up in 300 ml of water, is reprecipitated by stirring and is filtered once more. Drying in vacuo (200 mbar) at 60° C. leaves 80.5 g (theoretical: 81.5 g) of a greenish grey powder. The copper content in the product was measured as 28.9%.

APPLICATION EXAMPLES

Example 1a 100 parts of a nylon 6 fibre material are entered into 2,000 parts of an aqueous dyeing liquor which contains 0.065 part of the copper complex (1)

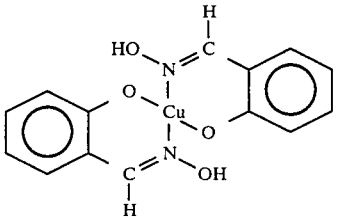

and 0.15 part of the metal complex dyestuff of the formula

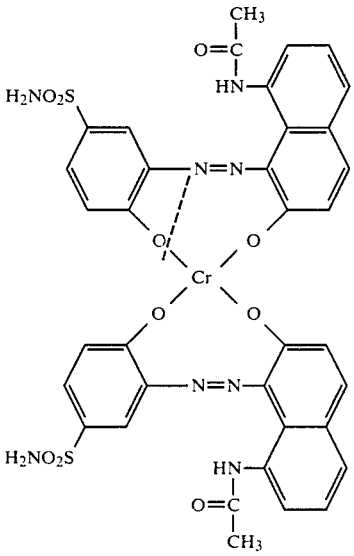

Disodium phosphate and monosodium phosphate are added to bring the dye liquor to pH 8. The liquor temperature is then slowly raised to 98°–100° C. and is held at this temperature for 60 minutes, the textile material being agitated all the while.

The dyeing is then removed from the dyebath, is rinsed and is dried.

The dyeing, and a comparative dyeing prepared without (1), are exposed for 250 hours in a Xenon test instrument as stipulated by Adam Opel AG
Russelsheim/West Germany
GM (Engineering Standards Europe)
GME No 60 202 A/B The dyeing treated with (1) has a much better light fastness than the comparison.

Example 1b

A similar light fastness improvement is obtained by bringing the liquor not to pH 8, but, by means of trisodium phosphate, to pH 10.

Example 1c

The light fastness improvement is retained in full if the dyeings prepared in 1a and 1b are finally heat-set at 180° C. in the course of 30 seconds.

Example 2

100 parts of nylon 6 material are entered into 2,000 parts of an aqueous dyeing liquor which contain 0.1 part of the copper complex (1) described in Example 1 and 0.5 part of the dyestuff of the formula

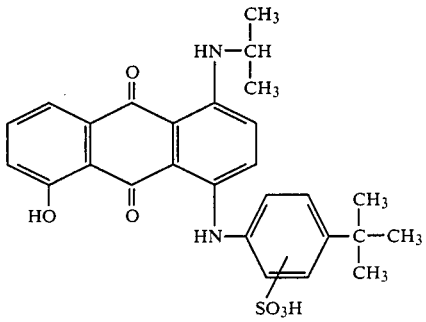

The dyeing liquor is brought to pH 6 by means of a buffer mixture consisting of monosodium phosphate and acetic acid. The textile material is treated at 98°–100° C. for 1 hour, is rinsed and is dried.

The dyeing thus prepared is found to have a much better light fastness than the one without (1) by the 250 hours of exposure in the Opel test.

If the dyeing is carried out at pH 4 instead of at pH 6, the light fastness improvement is similar and much better than a dyeing prepared in accordance with the Application Example $2a_1$ of German Patent Specification No. 3,041,153 A1.

Example 3a

Example 1 is repeated, except that 0.75% (in the form of a 10% strength aqueous dispersion) of the salicylhydroxamic acid/copper compound described in Example 1 is used (on weight of fibre) in place of the copper complex (1), affording a marked improvement in light fastness not only at pH 8 but also at pH 6.

Example 3b

Example 3a is repeated, except that the salicylhydroxamic acid/copper compound described in the Preparation Example 2 is used, affording a marked improvement in light fastness not only at pH 8 but also at pH 6.

Example 4

A nylon 6 dye is conventionally prepared from a long liquor with the dyestuff Acid Yellow 151 (C.I. 14 906) and is dried.

This dyeing is pad-mangled with a 100% liquor pick-up of a padding liquor which contains per liter 1 g of a 10% strength aqueous dispersion of the copper complex described in Example 1.

The pad-mangling is followed by drying at about 100° C. and then setting at 180° C. in the course of 30 seconds. The yellow dyeing thus treated has a much higher light fastness than a dyeing prepared without using the copper complex described.

Example 5a 100 parts of nylon 6 fibre material are entered into 2,000 parts of an aqueous dyeing liquor which contains 0.1 part of the copper complex

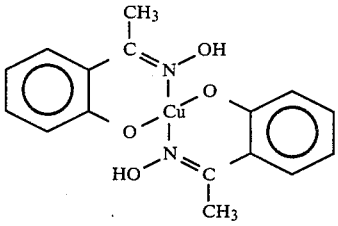

(2)

and 0.15 part of the metal complex dyestuff of Example 1a.

The dyeing liquor is brought to pH 8 by adding disodium phosphate and monosodium phosphate. The liquor temperature is then slowly raised to 98°-100° C. and is held at this temperature for 1 hour, the textile material being agitated all the while. The dyeing is then rinsed and dried.

The dyeing is exposed to light together with a dyeing prepared without (2).

The dyeing treated with (2) has a much better light fastness.

Example 5b

An equally good light fastness is obtained by bringing the dyeing liquor not to pH 8 but to pH 6.

Example 5c

The light fastness improvement is fully retained if the dyeings prepared in 5a and 5b are then heat-set at 180° C. in the course of 30 seconds.

Example 6 (comparative example)

Example 1a is repeated, except that the copper complex (1) is replaced by the corresponding nickel complex, of which 0.1% are used on weight of fibre, affording no improvement in light fastness not only at pH 6 but also at pH 8. On exposure to light the dyeing behaves as though no optical stabiliser had been added to the dyeing liquor.

Example 7a 100 parts of nylon 6 textile material are entered into 2,000 parts of an aqueous dyeing liquor which contain 0.1 part of salicylaldoxime (I, R=H) and 0.2 part of the metal complex dyestuff of Example 1a.

The dyeing liquor is brought to pH 8 by adding disodium phosphate and monosodium phosphate. While the textile material is being constantly agitated, the temperature of the dyeing liquor is gradually raised to 98°-100° C. and is left at this value for 60 minutes.

The liquor is cooled down, and the nylon material is removed, is briefly rinsed and is entered into 2,000 parts of a fresh dyeing liquor which contain 0.1 part of $CuSO_4.5H_2O$. When the liquor has been gradually heated to 98°-100° C., the dyeing is treated at this final temperature for 30 minutes. The textile material is kept in uniform motion throughout the entire treatment period.

The dyeing liquor is cooled down, and the dyed textile material is removed, is rinsed and is dried.

The dyeing is exposed to light in the Opel test, together with a dyeing prepared without the salicylaldoxime/copper sulphate aftertreatment. The dyeing prepared in two baths by means of salicylaldoxime/-$CuSO_4.5H_2O$ has a much better light fastness.

Example 7b

An equally good light fastness is obtained when the dyeing liquor containing the salicylaldoxime is brought to pH 6 and not pH 8.

Example 7c

A heat-setting of the dyeings prepared in 7a and 7b at 180° C. for 30 seconds—a treatment which is customary in the textile industry as a final treatment—has no adverse effect on the light fastness.

We claim:

1. In the improvement of the lightfastness of a dyed polyamide textile material by applying to the textile material before, during or after dyeing a fastness improver, the improvement wherein such fastness improver consists essentially of a copper complex of an optionally ring substituted compound of the formula

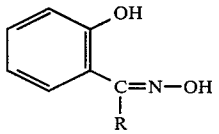

in which R is H, OH, alkyl or cycloalkyl.

2. A process according to claim 1, wherein the copper complex is employed in 0.01 to 2% by weight of fiber.

3. A process according to claim 1, wherein R is H.

4. A process according to claim 1, wherein R is OH.

5. A process according to claim 1, wherein the copper complex is present in the dyebath.

6. A process according to claim 1, wherein the copper complex is produced in situ on the fiber from the corresponding starting materials.

7. A process according to claim 1, wherein the polyamide is dyed with a metal complex dyestuff.

8. A process according to claim 1, wherein the polymide is nylon.

* * * * *